US007759610B2

(12) United States Patent
Brun et al.

(10) Patent No.: US 7,759,610 B2
(45) Date of Patent: Jul. 20, 2010

(54) HEATING ASSEMBLY COMPRISING A PTC ELEMENT, IN PARTICULAR FOR A MOTOR VEHICLE

(75) Inventors: Michel Brun, Rustenhard (FR); Christophe Schmittheisler, Epfig (FR); Pascal Miss, Selestat (FR); Maxime Mundel, Pfaffenheim (FR); Mathieu Mougey, Ensisheim (FR)

(73) Assignee: Behr France Rouffach SAS, Rouffach (FR)

( * ) Notice: Subject to any disclaimer, the term of this patent is extended or adjusted under 35 U.S.C. 154(b) by 736 days.

(21) Appl. No.: 10/574,543

(22) PCT Filed: Sep. 15, 2004

(86) PCT No.: PCT/EP2004/010328

§ 371 (c)(1),
(2), (4) Date: Aug. 15, 2006

(87) PCT Pub. No.: WO2005/039242

PCT Pub. Date: Apr. 28, 2005

(65) Prior Publication Data

US 2007/0000902 A1 Jan. 4, 2007

(30) Foreign Application Priority Data

Oct. 7, 2003 (EP) ..... 03292474

(51) Int. Cl.
*H05B 3/42* (2006.01)
*H01C 7/10* (2006.01)

(52) U.S. Cl. ..... 219/242; 338/22 R

(58) Field of Classification Search ..... 219/200–242, 219/540–548
See application file for complete search history.

(56) References Cited

U.S. PATENT DOCUMENTS

| | | | | |
|---|---|---|---|---|
| 4,865,039 | A * | 9/1989 | Dunseath, Jr. | 600/410 |
| 5,211,174 | A * | 5/1993 | Imran | 600/396 |
| 6,313,996 | B1 * | 11/2001 | Yamanashi | 361/706 |
| 6,659,783 | B2 * | 12/2003 | Copper et al. | 439/181 |
| 2003/0027447 | A1 * | 2/2003 | Cooper et al. | 439/181 |

FOREIGN PATENT DOCUMENTS

| | | | |
|---|---|---|---|
| DE | 101 44 757 | A1 | 3/2003 |
| EP | 1 182 908 | B1 | 4/2003 |
| JP | 2008-053628 | A | 3/2008 |

* cited by examiner

*Primary Examiner*—Daniel L Robinson
(74) *Attorney, Agent, or Firm*—Foley & Lardner LLP

(57) ABSTRACT

The invention relates to a heating assembly comprising at least one PTC element, in particular for a motor vehicle. According to the invention, the PTC element (2) is positioned between metal sheets (3, 4), which are used to make electrical contact, said sheets (3, 4) and the PTC element (2) are bonded by means of an adhesive (5) and the adhesive (5) has a minimum specific electrical resistance of 50 ohms×cm and a maximum specific electrical resistance of 500 ohms×cm. In addition, solder can be used as an alternative to the adhesive (5).

16 Claims, 3 Drawing Sheets

HEATING ASSEMBLY COMPRISING A PTC ELEMENT, IN PARTICULAR FOR A MOTOR VEHICLE

The invention relates to a heating assembly with a PTC element, in particular for a motor vehicle.

BACKGROUND

DE 101 44 757 A1 discloses a heating assembly with a PTC element for passenger vehicles, a supplementary heating system being provided, having a heating element through which heating air flows during operation of the supplementary heating system and having at least one air outlet opening in the foot region of a passenger compartment, to which the heating air is conducted. To allow a vertical temperature stratification that is also comfortable in particular for seats at the rear to be produced in the passenger compartment in a flexible way, the heating element takes the form of an electrical PTC element, which is arranged directly at the air outlet opening in the foot region. A supplementary heater of this type still leaves something to be desired. According to one disclosed exemplary embodiment, a PTC element in the form of a number of heating honeycombs is arranged in a plastic frame (not described in any more detail), which surrounds the air outlet opening.

The attachment of contact plates to PTC elements conventionally takes place by means of an adhesive, insulating adhesives with a resistivity of over 10,000 ohms×cm or conducting adhesives with a resistivity of under 10 ohms×cm being used—depending on the application. Such bonds between the contact plate and the PTC element leave something to be desired.

SUMMARY

The object of the invention is to provide an improved heating assembly with a PTC element.

According to the invention, a heating assembly with at least one PTC element is provided, the PTC element being arranged between contact plates which serve for making electrical connection, the contact plates and the PTC element being bonded by means of an adhesive which has a resistivity of at least 50 ohms×cm and at most 500 ohms×cm, preferably of at least 80 ohms×cm and at most 150 ohms×cm, in particular of 100 ohms×cm+/−10%.

Allowance for heating and safety aspects is made at the same time if an adhesive with a certain resistivity, in particular an adhesive with a resistivity of 50 to 500 ohms×cm, is chosen, the PTC elements being bonded to contact plates by this electrically conducting adhesive. The resistivity is to be chosen here on the one hand such that the risk of a short-circuit between the contact plates is avoided. On the other hand, the resistivity is to be chosen such that, in the event of the heating assembly being damaged as a consequence of aging, the adhesive layer can undergo enforced relaxation, averting direct contact between the PTC element and the contact plates, but the adhesive layer having adequate electrical conductivity to maintain the heating function should this occur. In this case, the adhesive layer has an additional electrical resistance and displays acceptable heating output. The advantage of the invention is that in this case the heating function is not disturbed. The aforementioned range for the resistivity has been found to be that which is most suitable.

It is preferred for the layer thickness of the adhesive between the PTC element and a contact plate before enforced relaxation to be negligible and after enforced relaxation to be at most 0.02 μm, in particular 0.01 μm+/−10%.

Instead of an adhesive, a solder with a corresponding resistivity may also be used.

BRIEF DESCRIPTION OF THE DRAWINGS

The invention is explained in detail below on the basis of an exemplary embodiment with reference to the drawing, in which.

DETAILED DESCRIPTION

Figure 1:
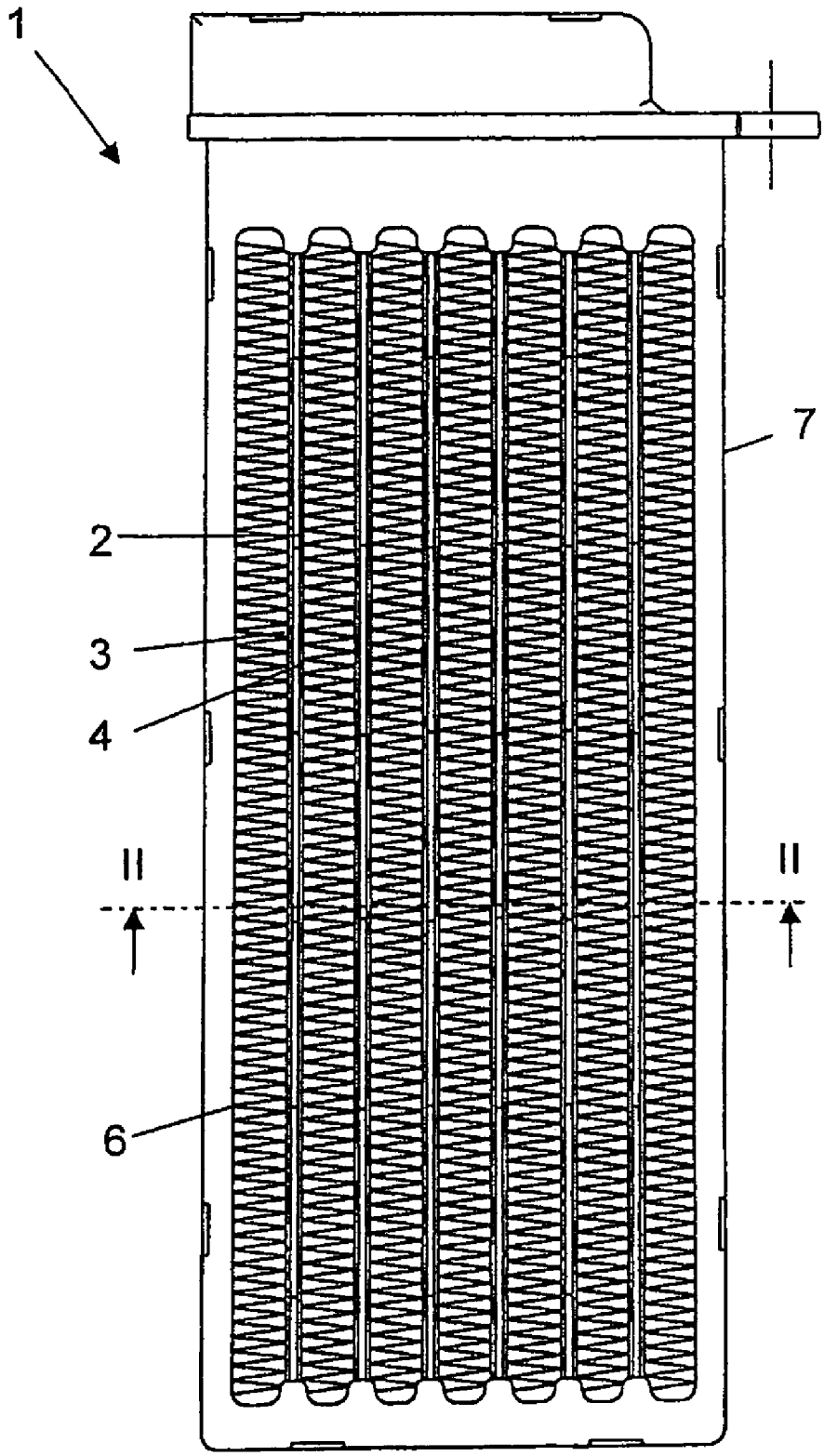
FIG. 1 shows a view of a heating assembly according to the invention.
Figure 2:
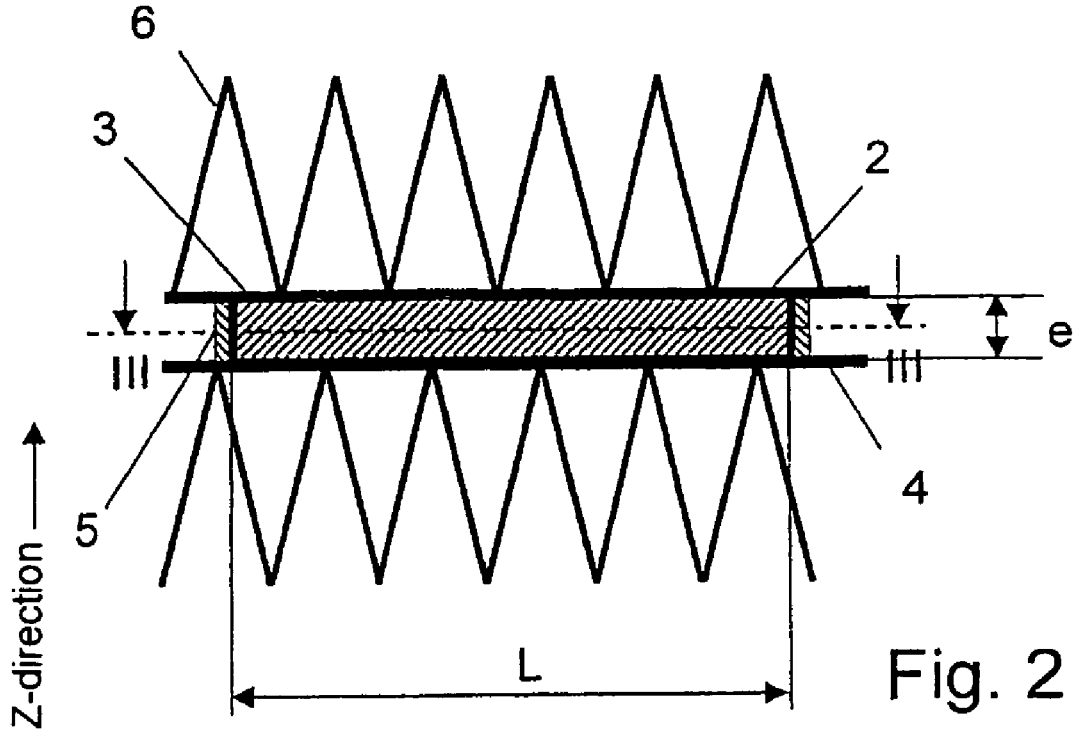
FIG. 2 shows an enlarged section through the heating assembly from FIG. 1 along the line II-II in FIG. 1.
Figure 3:
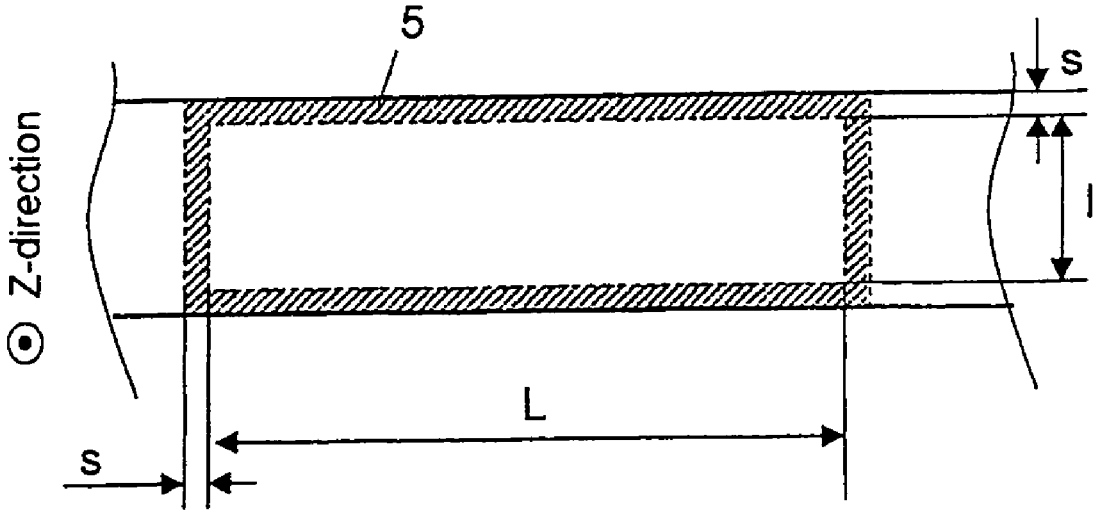
FIG. 3 shows a section along the line III-III in FIG. 2.
Figure 4:
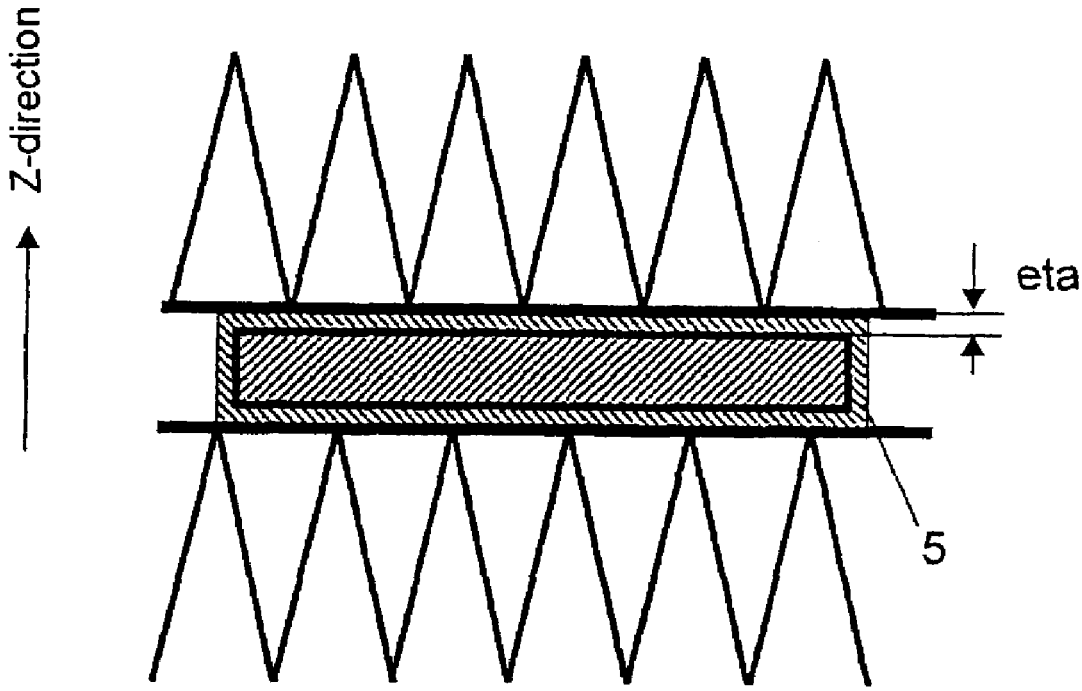
FIG. 4 shows a representation corresponding to FIG. 2 after enforced relaxation.

In the case of a PTC heating assembly 1 with ceramic PTC elements, a PTC element 2 is respectively bonded in place between two contact plates 3 (positive terminal) and 4 (negative terminal) that are arranged parallel to each other, in the present case by means of an adhesive 5 which has a resistivity of approximately 100 ohms×cm. Corrugated ribs 6 are attached by means of a corresponding adhesive bond on those sides of the contact plates 3 and 4 which in each case lie opposite the PTC element 2, and a respective further contact plate 3 and 4 is attached to said corrugated ribs, likewise by means of a corresponding adhesive bond. Arranged around the assembly described above is a plastic frame 7. The flow direction of the air is in the viewing direction in the case of FIG. 1.

Hereafter, the length of a PTC element 2 is denoted by L, in the present case 035 mm, the width of the PTC element 2 by, in the present case 8 mm, and the thickness of the PTC element 2 by e, in the present case 1.4 mm. The average thickness of the adhesive layer between the surface of the PTC element 2 and a contact plate 3 or 4 is denoted by eta, in the present case 0.01 μm. The width of the adhesive around the PTC element 2 between the contact plates 3 and 4 is denoted by s and in the present case is 1 mm.

The voltage between the contact plates 3 and 4 is denoted by U and, according to the present exemplary embodiment, is 13 V, but may also be greater, for example 48 V.

The resistivity of the adhesive 5 is denoted by $Rho_{adhes}$, the resistance of the PTC element 2 by $R_{PTC}$, the resistance of the adhesive layer between the PTC element 2 and the contact plate 3 or 4 by $R_{adhes}$.

The output of the PTC element 2 is denoted by $P_{PTC}$, the output of the adhesive 5 between the contact plates 3 and 4 by $P_b$, the output of the PTC element 2 in connection with the adhesive 5 without enforced relaxation by $P_{adhesion+PTC\ without\ enforced\ relaxation}$, the output of the PTC element 2 in connection with the adhesive 5 with enforced relaxation by $P_{adhesion+PTC\ after\ enforced\ relaxation}$, the overall output by $P_{total}$.

Here, the resistance $R_{adhes}$ of the adhesive 5 between the PTC element and a contact plate 3 or 4 and the resistance $R_b$ of the adhesive 5 surrounding the PTC element 2 is obtained as follows:

$$R_{adhes}=Rho_{adhes}\times eta/(L\times l) \quad (1)$$

$$R_b = Rho_{adhes} \times e/(2(L+l) \times s) \quad (2)$$

Figure 5:
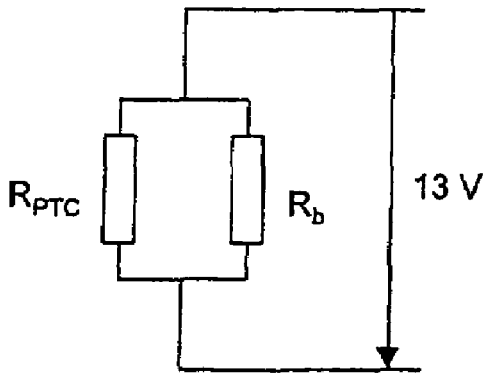
FIG. 5 shows an equivalent circuit diagram which illustrates the resistances.
Figure 6:
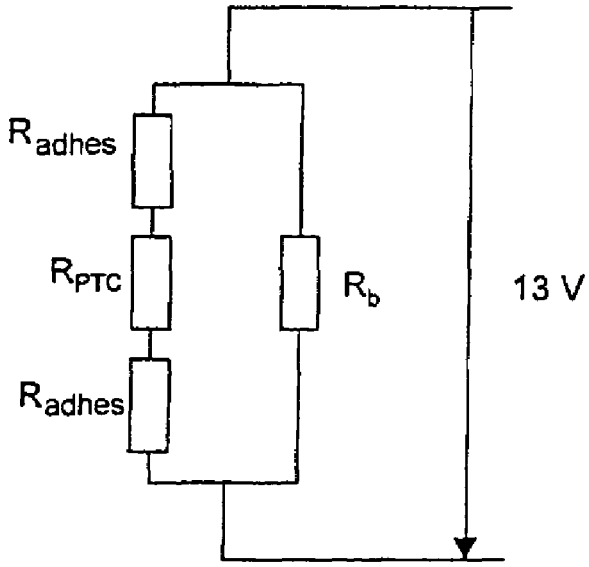
FIG. 6 shows an equivalent diagram corresponding to FIG. 5 which illustrates the resistances after enforced relaxation.

Equivalent diagrams for the circuits of the resistances are represented in FIGS. 5 and 6.

The output $P_{adhesion+PTC\ without\ enforced\ relaxation}$ and the output $P_{adhesion+PTC\ after\ enforced\ relaxation}$ are obtained by $$P_{adhesion+PTC\ without\ enforced\ relaxation} = U^2/R_{PTC} \quad (3)$$

$$P_{adhesion+PTC\ after\ enforced\ relaxation} = U^2/(2R_{adhes} + R_{PTC}) \quad (4)$$

To bring about optimum efficiency of the PTC element 2, the ratio $R_{PTC}/R_b$ should be chosen to be as great as possible. Furthermore, however, the ratio of $P_{adhesion+PTC\ without\ enforced\ relaxation}/P_{adhesion+PTC\ after\ enforced\ relaxation}$ should lie as close as possible to 1. In this case, the ratio of $R_{PTC}/R_b$ lies in particular between about 4 and 40 and the ratio of $P_{adhesion+PTC\ without\ enforced\ relaxation}/P_{adhesion+PTC\ after\ enforced\ relaxation}$ lies between about 1.2 and 1.02.

LIST OF DESIGNATIONS

1 heating assembly
2 PTC element
3 contact plate
4 contact plate
5 adhesive
6 corrugated rib
7 plastic frame

The invention claimed is:

1. A heating assembly for a motor vehicle, comprising:
at least one PTC element,
contact plates configured to make an electrical connection with the at least one PTC element, and
ribs connected to sides of the contact plates that are opposite to sides of the contact plates electrically connected to the at least one PTC element,
wherein the at least one PTC element is arranged between the contact plates,
wherein the contact plates and the at least one PTC element are bonded by an adhesive,
wherein the adhesive has a resistivity of at least 50 ohms×cm and at most 500 ohms×cm.

2. The heating assembly as claimed in claim 1, wherein the adhesive has a resistivity of at least 80 ohms×cm and at most 150 ohms×cm.

3. The heating assembly as claimed in claim 1, wherein a layer thickness of the adhesive between the at least one PTC element and one of the contact plates before enforced relaxation is negligible and after enforced relaxation is at most 0.02 μm.

4. A heating assembly for a motor vehicle, comprising:
at least one PTC element,
contact plates configured to make an electrical connection with the at least one PTC element, and
ribs connected to sides of the contact plates that are opposite to sides of the contact plates electrically connected to the at least one PTC element,
wherein the at least one PTC element is arranged between the contact plates,
wherein the contact plates and the PTC element are bonded by a solder,
wherein the solder has a resistivity of at least 50 ohms×cm and at most 500 ohms×cm.

5. The heating assembly as claimed in claim 4, wherein the solder has a resistivity of at least 80 ohms×cm and at most 150 ohms×cm.

6. The heating assembly as claimed in claim 4, wherein a layer thickness of the solder between the PTC element and a contact plate before enforced relaxation is negligible and after enforced relaxation is at most 0.02 μm.

7. The heating assembly as claimed in claim 2, wherein a layer thickness of the adhesive between the PTC element and a contact plate before enforced relaxation is negligible and after enforced relaxation is at most 0.02 μm.

8. The heating assembly as claimed in claim 5, wherein a layer thickness of the solder between the PTC element and a contact plate before enforced relaxation is negligible and after enforced relaxation is at most 0.02 μm.

9. The heating assembly as claimed in claim 2, wherein the adhesive has a resistivity of 100 ohms×cm+/−10%.

10. The heating assembly as claimed in claim 3, wherein the layer thickness of the adhesive between the PTC element and a contact plate before enforced relaxation is negligible and after enforced relaxation is 0.01 μm+/−10%.

11. The heating assembly as claimed in claim 5, wherein the solder has a resistivity of 100 ohms×cm+/−10%.

12. The heating assembly as claimed in claim 6, wherein the layer thickness of the solder between the PTC element and a contact plate before enforced relaxation is negligible and after enforced relaxation is 0.01 μm+/−10%.

13. The heating assembly as claimed in claim 1, wherein a ratio of a resistance of the at least one PTC element to a resistance of the adhesive surrounding the at least one PTC element is between about 4 and 40.

14. The heating assembly as claimed in claim 4, wherein a ratio of a resistance of the at least one PTC element to a resistance of the solder surrounding the at least one PTC element is between about 4 and 40.

15. The heating assembly as claimed in claim 1, wherein a ratio of an output of the PTC element with the adhesive without enforced relaxation to an output of the PTC element in connection with the adhesive with enforced relaxation is between about 1.2 and 1.02.

16. The heating assembly as claimed in claim 4, wherein a ratio of an output of the PTC element with the solder without enforced relaxation to an output of the PTC element in connection with the solder with enforced relaxation is between about 1.2 and 1.02.

* * * * *